US005579833A

United States Patent [19]

Wijkstrom

[11] Patent Number: 5,579,833

[45] Date of Patent: Dec. 3, 1996

[54] HEAT EXCHANGER TANK

[75] Inventor: Bjorn Wijkstrom, Asarum, Sweden

[73] Assignee: Valeo Engine Cooling A.B., Mjally, Sweden

[21] Appl. No.: 420,222

[22] Filed: Apr. 11, 1995

[30] Foreign Application Priority Data

Apr. 12, 1994 [SE] Sweden ..... 9401211

[51] Int. Cl.[6] ..... F28F 9/02

[52] U.S. Cl. ..... 165/173; 165/151; 165/153; 165/175

[58] Field of Search ..... 165/151, 153, 165/173, 175

[56] References Cited

U.S. PATENT DOCUMENTS

| | | | |
|---|---|---|---|
| 2,073,778 | 3/1937 | Bofrger | 165/151 X |
| 2,539,701 | 1/1951 | Przyborowski | 165/173 X |
| 3,703,925 | 11/1972 | Ireland et al. | 165/151 |
| 4,738,308 | 4/1988 | Moranne | 165/151 X |
| 4,971,145 | 11/1990 | Lyon | 165/173 |

FOREIGN PATENT DOCUMENTS 0374896 6/1990 European Pat. Off. .

*Primary Examiner*—Leonard R. Leo
*Attorney, Agent, or Firm*—Morgan & Finnegan, LLP

[57] ABSTRACT

A heat-exchanger tank consisting of a cover (1) and a plate (2) connected to the cover at the opening thereof, said cover (1) having two opposed long side edges, each disposed in a groove (15, 16) at the corresponding long side edges of the plate (2), the plate (2) being provided at its end portions with a flange (17) projecting from the principal plane of the plate (2); the cover (1) being provided at its end portions with a corresponding flange (10) overlapping the plate flange (17); and a fixing means (13) being formed on the cover flange (10) and the plate flange (17) being arranged so as, once the cover and the plate are assembled, to fix the cover to the plate for interconnection thereof.

The invention also relates to a method for producing a heat exchanger.

4 Claims, 2 Drawing Sheets

HEAT EXCHANGER TANK

FIELD OF THE INVENTION

The invention relates to a heat-exchanger tank and, more particularly but not exclusively, to a heat-exchanger tank comprising a cover and a plate, the cover having a opening and the plate being connected to the cover at the opening, the cover having two opposed end portions and two opposed long side edges, and the plate having corresponding end portions and corresponding sides, each side being provided with a groove adapted to receive one of said edges.

The invention also relates to a process for the production of a heat-exchanger tank and to a heat exchanger.

BACKGROUND OF THE INVENTION

Heat exchangers are used, inter alia, in motor vehicles such as trucks and passenger cars, in the form of vehicle coolers, for the purpose of cooling the engine block by means of circulating liquid.

A conventional vehicle cooler consists partly of two tanks, partly of a heat-exchanger assembly which is situated therebetween and is connected to the tanks. The one tank serves as a collecting point for the heated-up liquid arriving from the engine block, while the other tank collects the cooled liquid from the heat-exchanger assembly and leads it out to the engine block. There are also heat-exchanger constructions having only one tank, in which case the liquid is led into and out of the same tank.

A conventional and very common type of vehicle cooler has tanks consisting of a plastics cover and an end plate made from an aluminum alloy, while the rest of the cooler, like the end plate, is manufactured in aluminum. The cover forms an upward-facing and downward-facing trough, which is situated on top of an end plate belonging to a heat-exchanger assembly forming part of the vehicle cooler, a gasket, for sealing purposes, being placed between the plastics trough and the end plate.

The above-stated construction has the major drawback that two totally different materials are required for the creation of the vehicle cooler tank. The design of the vehicle cooler tank and hence the entire vehicle cooler in two different materials has negative consequences in terms of the recoverability of the vehicle in which the cooler is placed. Since plastic and metal are recovered under totally different processes, the cover of the tank would have to be separated from the other part of the vehicle cooler prior to recovery, this entailing extra costs which make rational recovery more difficult.

The drawback of designing the vehicle cooler tank in two different materials is eliminated by means of a conventional type of vehicle cooler in which both the heat-exchanger assembly and the tank are manufactured in brass. The tank is formed by a cover in the form of an upward-facing and downward-facing trough, which is placed on top of an end plate of the heat-exchanger assembly. The edges of the trough are fitted into a V-shaped groove extending along the edge portions of the end plate. The joining-together of the trough and the end plate is further realized by means of soft-soldering, by a solder material, preferably tin, filling the space between the edge portions of the cover and the walls of the groove.

The above-stated construction of the vehicle cooler tank has, however, a number of other drawbacks. As a result of the trough being placed in the groove of the end plate, various fixtures are required to detain the trough during the soldering procedure. The soldering operation is also time-consuming, since a solder material which is applied from outside would constantly have to be supplied in order to obtain the soldered joints. Furthermore, it is not very favorable to design the tank, and also the rest of the cooler moreover, in brass, since this results in a heavy construction, having an adverse effect upon the performance and fuel consumption of the vehicle, and in a construction having deficient corrosion characteristics.

There is therefore a need for a solution which is better relative to the two above-presented constructions.

The object of the invention is to eliminate the drawbacks with the latter constructions and, at the same time, to enable a heat exchanger to be produced in one and the same material.

SUMMARY OF THE INVENTION

According to one aspect of the present invention there is provided a heat-exchanger tank comprising a cover and a plate, the cover having a opening and the plate being connected to the cover at the opening, the cover having two opposed end portions and two opposed long side edges, and the plate having corresponding end portions and corresponding sides, each side being provided with a groove adapted to receive one of said edges, the plate being provided at its end portions with a flange, the flange depending from a principal plane of the plate, the cover being provided at its end portions with a cover flange corresponding to and overlapping said plate flange; and further comprising a securing device associated with the cover flange and the plate flange, operable, once the cover and the plate are assembled, to secure the cover to the plate for interconnection thereof.

According to another aspect, there is provided a method for producing a heat-exchanger tank consisting of a metal cover defining a cover opening and-a metal plate attached at said opening, wherein a flat plate blank is deep-drawn to form the plate, which is provided at its end portions with a flange depending from a principal plane of the plate; wherein the plate is bent at two long side edges thereof to form a V-shaped groove; wherein a cover blank is deep-drawn to form the cover, which is provided with flanges at its end portions and a fixing tongue projecting from the respective flange; wherein the cover and the plate are assembled such that the long side edges of the cover are received in the respective groove and wherein the cover flanges overlap the respective plate flange; wherein the tongues are bent round the respective plate flange edge and the free leg of the V-grooves is clamped against the cover to fix the cover and the plate to each other; and wherein the cover and the plate are permanently interconnected at the mutually engaging portions thereof.

BRIEF DESCRIPTION OF DRAWINGS

A preferred embodiment of the invention shall be described below with reference to the appended drawings, in which:

FIG. 1 shows a heat-exchanger tank, embodied as a vehicle cooler tank, according to the invention prior to assembly. The Figure shows only an end portion and part of a middle portion of the vehicle cooler tank, as well as the heat-exchanger assembly, since it will be realized that the rest of the vehicle cooler tank has a corresponding, though inverted appearance relative to the portion shown. The tank has a cover 1 and an end plate 2 connected to a heat-exchanger assembly 3, only part of which is shown in the drawing, which assembly 3, together with the tank according to the invention, forms part of a complete vehicle cooler. The cover 1 is also provided with at least one connecting socket, which is omitted for the sake of clarity.

Figure 1:
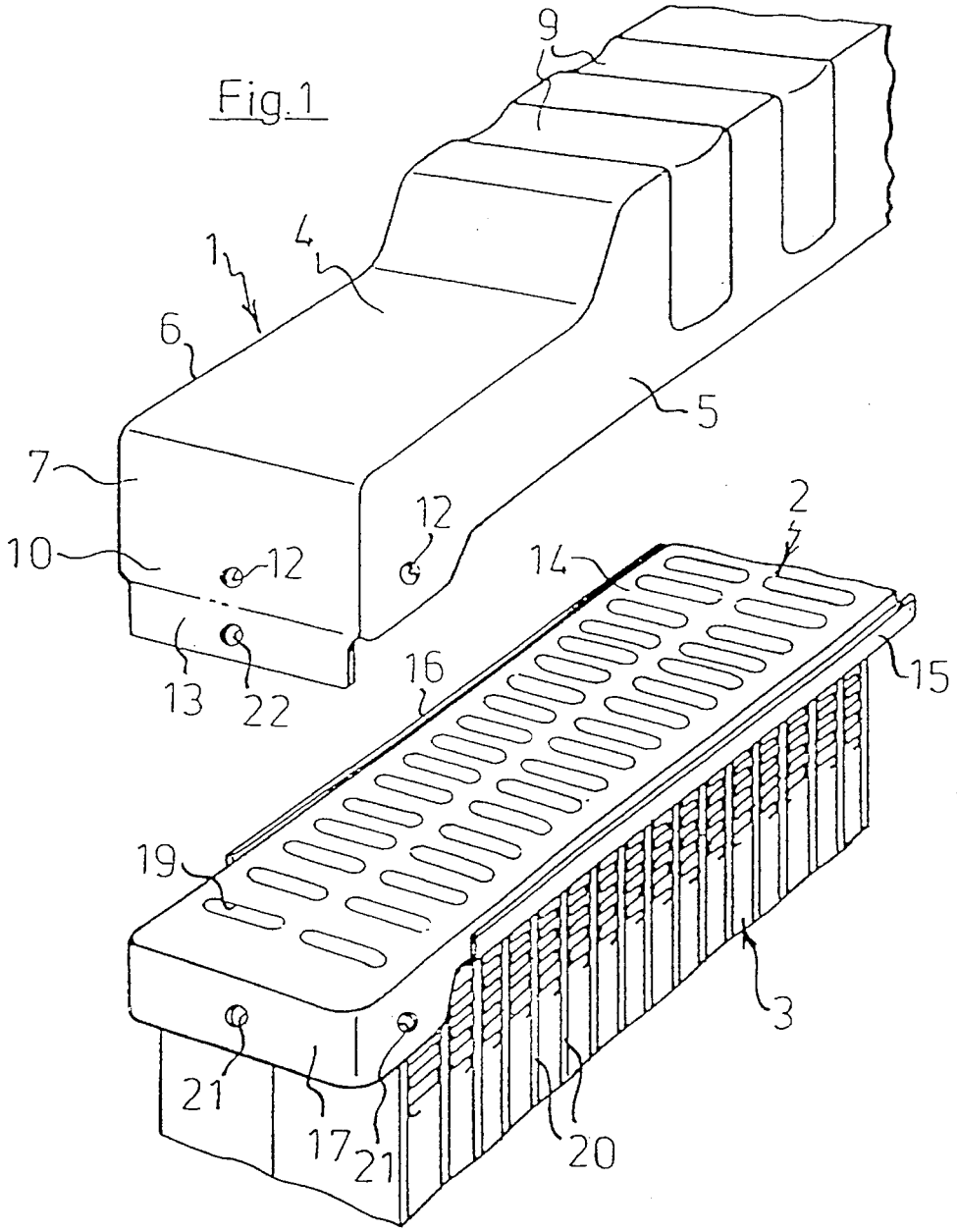
FIG. 1 is an exploded view showing part of a heat-exchanger tank according to the invention prior to assembly, being part of a heat-exchanger assembly.
Figure 2:
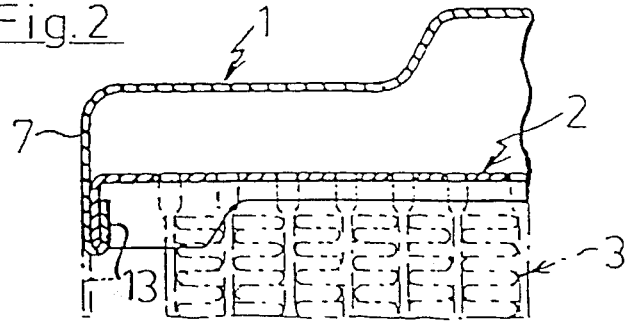
FIG. 2 is a longitudinal section of the heat exchanger tank when the cover is mounted on the end plate.

The cover 1, moreover, is trough-shaped in the upward-facing and downward-facing direction and has a top wall 4, two longitudinal side walls 5, 6 (only one of which is evident from the drawing) and two end-face walls 7, 8 (only one shown). The top wall 4 and side walls 5, 6 of the cover are formed along their respective middle portions with recesses 9 arranged for stiffening purposes. It is evident from FIG. 1 that the side walls 5, 6 of the cover 1 are higher at the middle portion of the cover 1 than at its end portions (only the one of which is shown), i.e. the trough is deeper at the middle portion of the cover than at the end portions.

Both end portions of the cover 1 have a flange 10, which extends from an end part of the one side wall 5, via the end-face wall 7, to an end part of the other side wall 6, and downwards from the respective side and end-face walls essentially in line with these. The flange 10 thus constitutes an extension of the side and end-face walls. The flange 10, furthermore, has fixture points in the form of holes 12. Extending downwards from the flange of the end-face wall, essentially in line with this, there is a tongue 13, which is also provided with a hole 22 and which is designed to fix the cover 1 to the end plate 2 in a manner which is described below.

The end plate 2 has a portion 14 forming the base of the tank. The end plate 2 further has a V-shaped groove 15, 16, extending along its long sides, for receiving the side walls 5, 6 of the cover 1. A flange 17, shaped correspondingly to the flange 10, extends essentially perpendicularly downwards from the portion 14 of the plate 2 and is formed in both end portions of the end plate. The flange 17 has fixture points in the form of holes 21 with corresponding placement to the holes 12. The end plate further has a number of openings 19 for receiving pipes 20 forming part of the heat-exchanger assembly 3.

The production of the two parts making up the tank, the cover and the end plate, as well as their assembly, is effected as follows.

The cover 1 is molded by deep-drawing to the shape which has been described above, while the end plate is firstly molded by deep-drawing, whereafter its long sides are bent outwards and upwards to form the V-shaped groove 15. The holes 12, 21 are realized by boring or similar.

The portion 14 of the plate 2 has external dimensions which conform to the internal dimensions of the cover so as to obtain a tight fitting when the two parts are assembled. The end face and side walls 5, 6 of the cover 1, as well as its flanges 10 and tongues 13, are slightly conical, preferably about 1°. The flanges 17 of the end plate and the inner legs of the groove 15, 16, i.e. the groove wall extending downwards from the portion 14, are also slightly conical and have approximately the same conicity as the walls, flanges and tongues of the cover. The conicity facilitates the deep-drawing operation and improves the fit between the cover 1 and the end plate 2.

By a certain pressing-apart of its walls, the cover 1 is then slipped on top of the end plate, so that its longitudinal edges are received in the grooves 15, 16 in such a way that the edges rest upon the base of the grooves 15, 16, while that part of the respective inner side wall which is situated in the respective groove 15, 16 is situated in contact against the inner leg of the groove. The flanges 10 of the cover herein overlap the flanges 17 of the end plate in a grip-fit, i.e. the inner surface of the flanges 10 of the cover 1 lies in tight contact against the outer surface of the flanges 17 of the end plate. The tongue 13, which in this position extends downwards from the edge of that part of the flange 17 which is situated on the end face of the end plate 2, is then bent round the end-face part of the flange 17 in order to realize a fixation upwards in the vertical direction.

The fixation in the horizontal direction is primarily realized by the tight engagement between the respective flanges 10 and 17, but the tongues 13 also play a part in this fixation. The groove 15, 16 prevents the cover from being guided too far downwards, since the side wall edges of the cover are received by the base of the groove 15, 16. The free, outer leg of the groove 15, 16 is then squeezed—or bent—inwards, so that the inner side of the outer wall bears against the lower portion of the side wall 5, 6, i.e. that portion which is situated in the groove.

Figure 3:
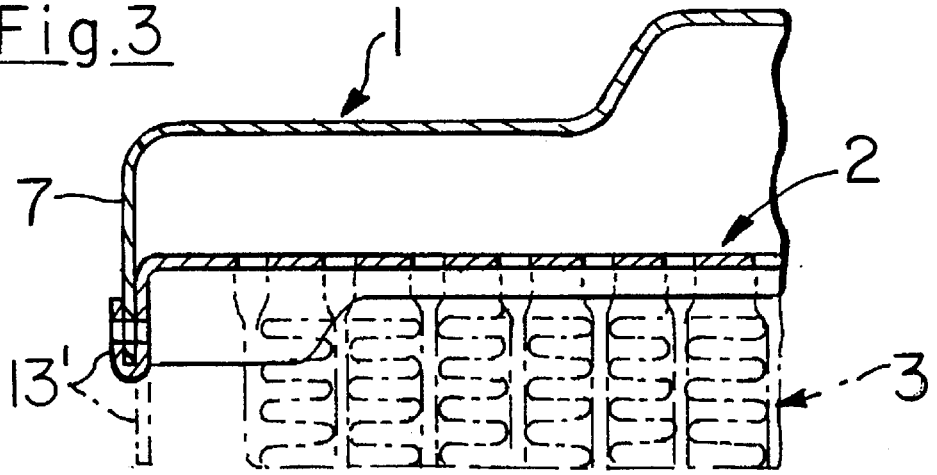
FIG. 3 is a longitudinal section of an alternate embodiment of the heat exchanger tank when the cover is mounted onto the end plate.

Finally, the cover is hard-soldered fixedly to the end plate by the entire tank, possibly also with the rest of the Vehicle cooler, being inserted into a furnace. The high temperature in the furnace melts the surface coating on the cover and the end plate, this material serving as a solder material and connecting the cover to the end plate. This is made possible by the fact that both the end plate 2 and the cover 1 have a coating of different aluminum alloy composition, so that this surface coating has a lower melting point than the aluminum in other parts of the cover and the end plate. FIG. 3 shows and alternate embodiment of the invention. In FIG. 3 plate 2 has a tongue 13' which is bent around end face wall 7 of the cover.

As a result of the invention, a cooler tank is therefore realized which is rational in terms of production technology, while at the same time being manufactured in aluminum alloy, thereby enabling it to be manufactured in the same material as a heat-exchanger assembly made from aluminum. Simple recoverability of an entire vehicle cooler is thereby realized.

The design of the tank enables the cover to be fixed on top of the end plate by means of the flanges and tongues, this being necessary to prevent the component parts from moving relative to one another in transport to the furnace or during the soldering procedure itself. The need for external fixtures for fixing the cover to the end plate is thereby eliminated.

As a result of the invention, other advantages are also attained. The relatively wide contact surface between the flanges produces a large soldering surface, which-means a strong soldered joint. The configuration of the downwardly extending flanges, moreover, also enables the side pieces or side members of the vehicle cooler to be secured in the holes incorporated in the flanges.

Finally, the invention is not limited to heat-exchanger tanks designed in an aluminum alloy, but other material can also enter into consideration, such as stainless steel, for example, in which case other methods can be envisaged for interconnecting the parts of the vehicle cooler tank.

Methods can also be envisaged for fixing the cover to the end plate, in the vertical direction upwards, other than by the use of a tongue. It is possible, for example, to replace the tongue with a rivet, bolt or the like.

What I claim is:

1. A heat exchanger tank comprising a cover and a plate, the cover having a opening and the plate being connected to the cover at the opening, the cover having two opposed end portions and two opposed long side edges, and the plate having corresponding sides, each side being provided with a groove adapted to receive one of said edges, the plate being provided at its end portions with a flange the flange depending from a principal plane of the plate, the cover being provided with at its end portions with a cover flange corresponding to and overlapping said plate flange; and further comprising a tongue on one of the plate flange and the cover flange bent around the other one of the plate flange and the cover flange and secured through fixture holes.

2. The heat-exchanger tank of claim 1, wherein the cover and plate flanges are each adapted for attachment of other heat-exchanger components.

3. A heat exchanger having a heat-exchanger assembly and at least one heat-exchanger tank in accordance with claim 1.

4. A method for producing a heat exchanger tank consisting of a metal cover defining a cover opening and a metal plate attached at said opening, wherein a flat plate blank is deep-drawn to form the plate, which is provided at is end portions with a flange depending from a principal plane of the plate; wherein the plate is bent at two long side edges thereof to form a V-shaped groove; wherein a cover blank is deep-drawn to form the cover which is provided with flanges at its end portions and a fixing tongue projecting from a respective flange; wherein the cover and the plate are assembled such that long side edges of the cover are received in a respective groove and wherein the cover flanges overlap a respective plate flange; wherein the tongues are bent round a respective plate flange edge and secured through fixture holes and a free leg of the V-grooves is clamped against the cover to fix the cover and the plate to each other; and wherein the cover and the plate are permanently interconnected at mutually engaging portions thereof.

* * * * *